US006956178B2

(12) United States Patent
Bosco

(10) Patent No.: US 6,956,178 B2
(45) Date of Patent: Oct. 18, 2005

(54) SWITCH FOR ROOF LIGHTS

(75) Inventor: Eugenio Bosco, Rivoli (IT)

(73) Assignee: Olsa S.p.A., Rivoli (IT)

( * ) Notice: Subject to any disclaimer, the term of this patent is extended or adjusted under 35 U.S.C. 154(b) by 0 days.

(21) Appl. No.: 10/841,615

(22) Filed: May 7, 2004

(65) Prior Publication Data

US 2004/0256209 A1 Dec. 23, 2004

(30) Foreign Application Priority Data

Jun. 18, 2003 (IT) ..... TO2003A0463

(51) Int. Cl.[7] ..... H01H 3/12
(52) U.S. Cl. ..... 200/277.1; 200/544; 200/523
(58) Field of Search ..... 200/341, 238, 200/292, 16 C, 277, 277.1, 277.2, 275, 240, 523, 527–573

(56) References Cited

U.S. PATENT DOCUMENTS 3,691,333 A * 9/1972 Elliott et al. ..... 200/526
4,112,277 A * 9/1978 Kleeb ..... 200/524
5,089,678 A * 2/1992 Zemp et al. ..... 200/526
5,579,903 A * 12/1996 McEvilly et al. ..... 200/524
5,736,696 A * 4/1998 Del Rosso ..... 200/5 R
6,124,556 A * 9/2000 Thalhammer ..... 200/16 R

* cited by examiner

*Primary Examiner*—Lincoln Donovan
*Assistant Examiner*—M. Fishman
(74) *Attorney, Agent, or Firm*—Merchant & Gould P.C.

(57) ABSTRACT

A switch (1) for roof lights (2) has: a supporting frame (3); a push-button (7) slidably mounted on the frame (3); a printed circuit, which is associated to the frame (3) and defines two operative positions for a lamp-bulb; and an actuator (13), which is set between the push-button (7) and the printed circuit (8) and is moved by the push-button (7) between the two operative positions; the actuator (13) being provided with a rolling element (18), which can roll on the printed circuit (8) between the two operative positions, and an motion-imparting arm (15), which supports the rolling element (18) and is actuated by the push-button (7) for moving the rolling element (18) itself between the operative positions.

7 Claims, 2 Drawing Sheets

SWITCH FOR ROOF LIGHTS

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

FIELD OF THE INVENTION

The present invention relates to a switch for roof lights.

BACKGROUND OF THE INVENTION

In general, switches for roof lights of a known type comprise:

a supporting frame having an open end wall;

a push-button, which is supported by the frame and is mobile with respect to the frame itself for switching on and switching off a lamp-bulb supported by the frame;

an electric circuit, which is set so as to close partially and end wall and defines two operative positions for the lamp-bulb; and an actuator, which is set between the push-button and the electric circuit and is moved by the push-button between the two operating positions.

Normally, the actuator is defined by a plate made of conductive material, which is made to slide on the printed circuit between the two operative positions, each time actuating the push-button.

The switch for roof lights of the type described above presents a drawback due to slipping of the actuator on the printed circuit and the corresponding friction, which brings about, in the long run, wearing-out of both of the components.

The purpose of the present invention is to provide a switch for roof lights which will be free from the drawback described above.

BRIEF SUMMARY OF THE INVENTION

According to the present invention, a switch for roof lights is provided, comprising: a supporting frame; a push-button slidably mounted on the frame; a printed circuit, which is associated to the frame and defines two operative positions for a lamp-bulb; and an actuator, which is set between the push-button and the printed circuit and is moved by the push-button between the two operative positions; said switch being characterized in that the actuator comprises a rolling element, which can roll on the printed circuit between the said two operative positions, and an motion-imparting arm, which supports the rolling element and is actuated by the push-button for moving the rolling element itself between the operative positions.

BRIEF DESCRIPTION OF THE SEVERAL VIEWS OF THE DRAWINGS

The invention will now be described with reference to the annexed drawings, which illustrate a non-limiting example of embodiment thereof, and in which.

DETAILED DESCRIPTION OF THE INVENTION

Figure 1:
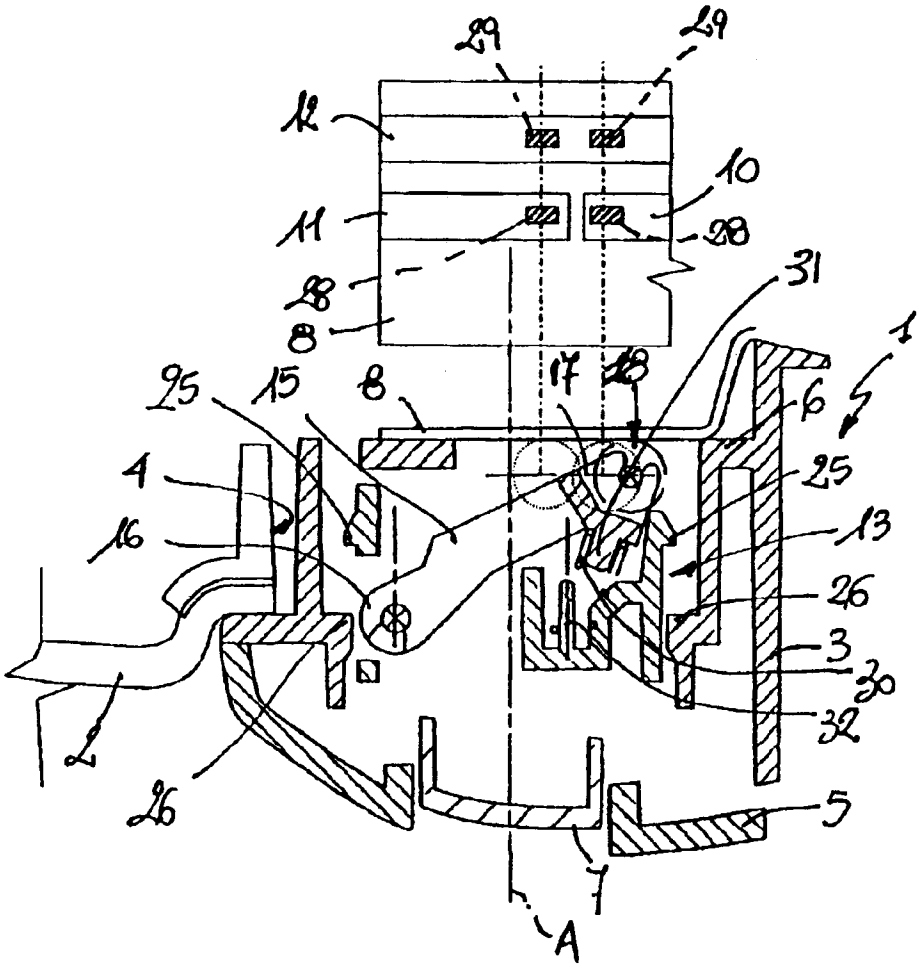
FIGS. 1, 2 and 3 are cross-sectional views with sectioned parts and parts removed for reasons of clarity, of a preferred embodiment of the switch according to the present invention, in respective operating positions.
Figure 5:
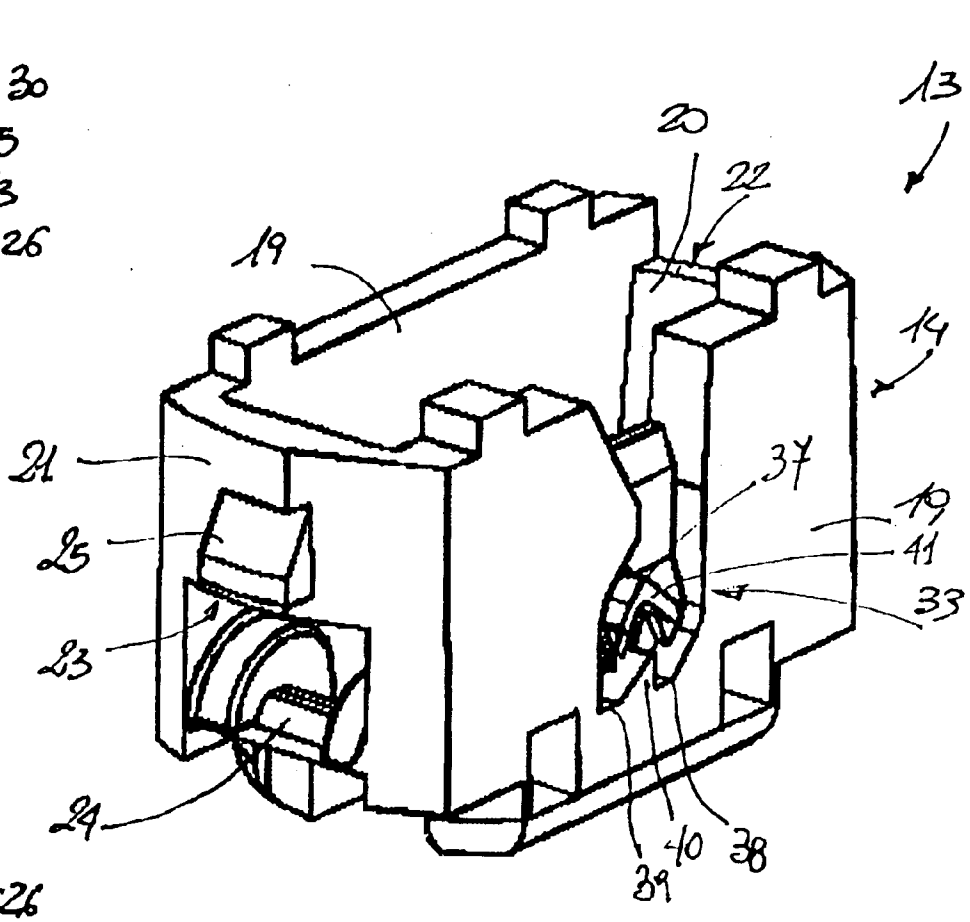
FIG. 5 is a perspective view of a detail of the switch of FIG. 4.
Figure 2:
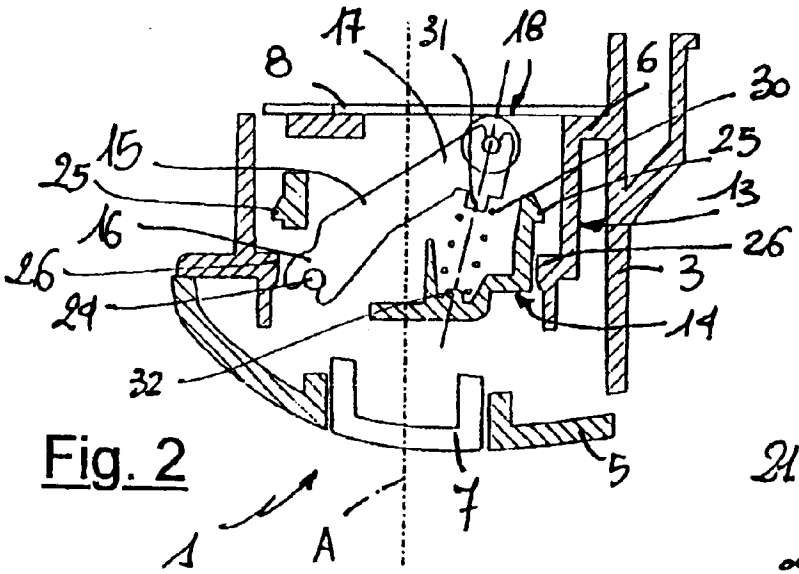
Figure 3:
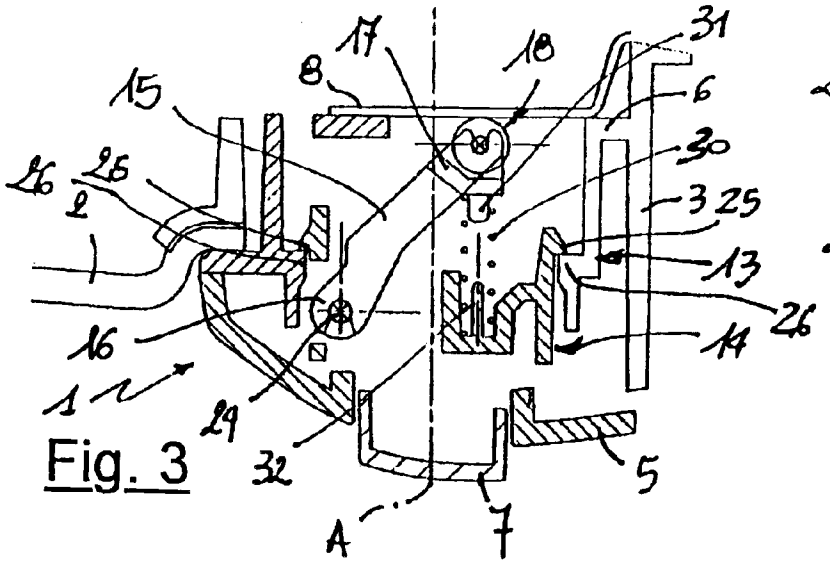

With reference to FIGS. 1, 2, and 3, the reference number 1 designates, as a whole, a switch for a roof light 2 provided with a light-bulb (of a known type and not illustrated) for lighting the inside of a motor vehicle.

The switch 1 comprises: a supporting frame 3, which is mounted in a housing 4 of the roof light 2 and has a substantially curved front wall 5 and an open rear part 6; and a push-button 7, which is mounted through the front wall 5 and is able to slide along an axis A of movement between two operative positions, as will be explained more fully in what follows.

The switch 1 further comprises a printed circuit 8, which is mounted so as to close the rear wall and in turn comprises, as illustrated schematically in plan view in FIG. 1, a first path 10 and a second path 11, which are both made of conductive material and are set aligned to one another but separate from one another. The switch 1 further comprises a continuous path 12 made of conductive material, which is set adjacent and parallel to the two paths 10 and 11.

Finally, the switch 1 comprises an actuator 13, set between the push-button 7 and the printed circuit 8 and is moved by the push-button 7 between a first operative position, illustrated in FIG. 2, in which the push-button 7 is set flush with the wall 5, and a second operative position, illustrated in FIG. 3, in which the push-button 7 projects from the wall 5.

Passage of the actuator 13 between the first operative position and the second operative position occurs through an intermediate operative position, illustrated in FIG. 1, in which the push-button 7 is set in with respect to the wall 5.

Figure 4:
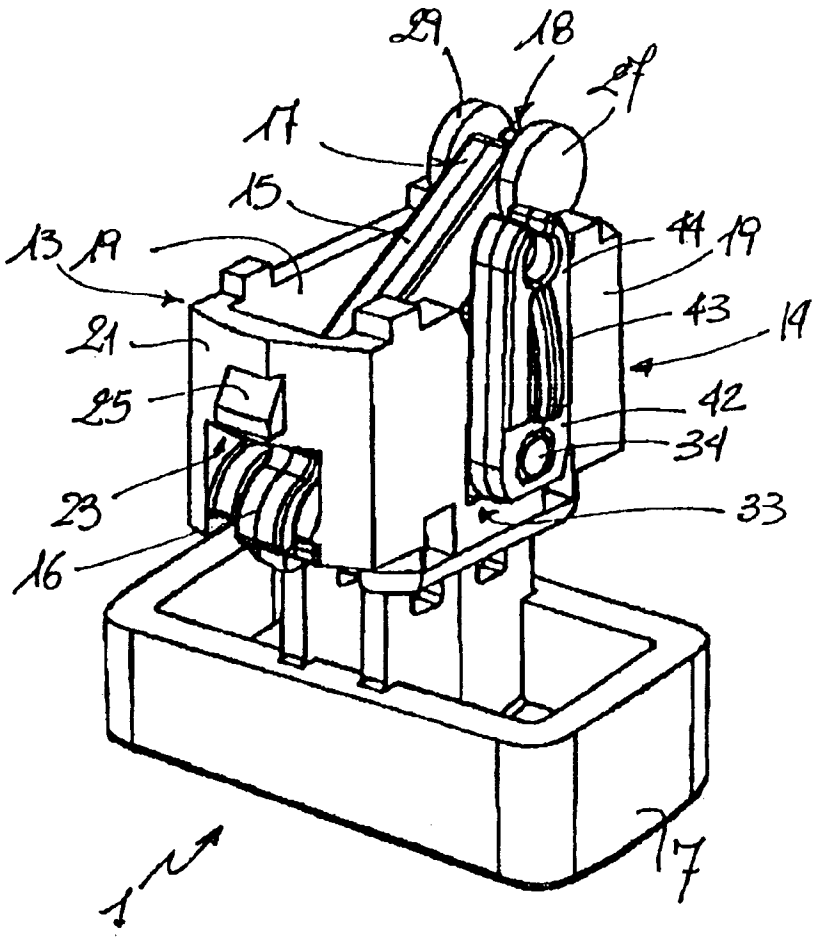
FIG. 4 is a perspective view at an enlarged scale of a detail of the switch of FIG. 1.

According to what is illustrated in greater detail in FIG. 4, the actuator 13 comprises: a containing body 14, which is mounted so that it can slide along the axis A within the frame 3 and is rigidly coupled to the push-button 7; and an motion-imparting arm 15, which has one end 16 thereof pivoted on the body 14, and a second end 17 thereof set facing the circuit 8.

The actuator 13 further comprises a rolling element 18 made in the form of a rocket, which is coupled in such a way that it can turn at the end 17 of the arm 15, is entirely made of conductive material, and is set forming a bridge between the continuous path 12 and the path 10, in the first operative position, and between the continuous path 12 and the second path 11, in the second operative position.

The containing body 14 is an open annular body extending along the axis A, and comprises two larger plane walls 19 set facing and parallel to one another on opposite sides of the arm 15, and two substantially curved smaller walls 20 and 21, which are transverse to the walls 19, and of which the wall 20 has, on the side facing the circuit 8, a cavity 22 for housing the rolling element 18, whilst the wall 21 has, on the side facing the push-button 7, a respective cavity 23. The body 14 further comprises a rod 24, which is fixed to the walls 19 and set transverse thereto and is set in the cavity 23 so as to define the fulcrum of rotation of the end 16 of the arm 15.

Finally, the body 14 comprises two wedge-shaped detents 25, which are fixed to the walls 20 and 21 and extend towards the outside of the walls 20 and 21 themselves to co-operate with respective detents 26 fixed to the frame 3, thus regulating the amplitude of the return travel of the body 14 itself and hence of the push-button 7.

The rolling elements 18 comprises a respective rod 27 slidably coupled to the end 17 of the arm 15, and two disks 28 and 29, which are angularly fixed to the rod 27 and are set on opposite sides of the arm 15 to roll on the printed circuit 8 and, in particular, to engage the path 10 or the path 11 and, respectively, the path 12.

The actuator 13 further comprises a helical spring 30 compressed between a pin 31, which is fixed to the end 17 and extends on the opposite side of the rolling element 18, and a further pin 32, which is fixed to the body 14 and extends towards the circuit 7. The actuator 13 finally comprises a desmodromic cam 33 made on the outside of one of the two walls 19, and a finger 34, which is engaged by the cam 33 and is designed to run over the cam 33 itself with a given direction of rotation.

In particular, the desmodromic cam 33 is substantially heart-shaped and comprises a cusp 37 facing the circuit 8, and two U-shaped parts 38 and 39, the concavities of which are oriented towards the cusp 37 itself and which are separated by a deviating prism 40 having a triangular shape. The cam 33 further comprises a deviating tile 41, which has substantially the shape of an skew V and is set facing the prism 40 and opened towards it. Instead, the finger 34 is supported, at one end 42 of an oscillating arm 43, which is set on the outside of the wall 19 and a further end 44 of which is pivoted on the frame 3.

In use, once the switch 1 is connected to the external electrical circuit of the vehicle, it enables turning-on of the aforesaid lamp-bulb upon opening of a door of the motor vehicle itself, or also when the actuator 13 is set in the position corresponding to the first operative position, or alternatively, direct turning-on of the aforesaid lamp-bulb 2, or else with the actuator 13 set in a position corresponding to the second operative position.

The description of the operation of the switch 1 will be made starting from the first operative configuration with the rolling element 18 set astride of the paths 10 and 11 and with the finger 34 set facing the cusp 37 of the cam 33.

Starting from said first operative configuration, a pressure on the push-button 7 brings about an axial displacement along the axis A of the push-button 7 itself against the resisting action of the spring 30, an oscillation of the motion-imparting arm 15 about the rod 24 and a displacement of the rolling element 18 towards the intermediate operative position. During the displacement of the rolling element 18 from the first operative position towards the intermediate operative position, the finger 34 hits against the title 37 and is invited to run over the U-shaped part 38 which defines a top dead centre for the displacement of the finger 34 itself.

At this point, a further pressure on the push-button 7 will not have any further effect, whilst release of the push-button 7 will bring about, under the elastic action of the spring 30, positioning of the finger 34 between the tile 37 and the prism 40, raising of the push-button 7 outside the wall 5 and, above all, positioning of the rolling element 18 in the second operative configuration with the disk 28 set in contact with the path 11 and with the disk 29 set in contact with the path 12.

Starting from this second operative position, a further pressure on the push-button 7 brings about an axial displacement along the axis A of the push-button 7 itself against the resisting action of the spring 30, an oscillation of the motion-imparting arm 15 about the rod 24 and a new displacement of the rolling element 18 towards the intermediate operative position. During the displacement of the rolling element 18 from the second operative position to the intermediate operative position, the finger 34 hits against the prism 40 and is invited to run over the U-shaped part 39, which defines a further top dead centre for the displacement of the finger 34 itself.

Also in this case, a further pressure on the push-button 7 will not have any further effect, whilst release of the push-button 7 will bring about, under the elastic action of the spring 30, positioning of the finger 34 on the outside of the tile 37, raising of the push-button 7 flush with the wall 5 and, above all, positioning of the rolling element 18 in the first operative configuration with the disk 28 set in contact with the path 10 and with the disk 29 set in contact with the path 12.

During all the displacements described above, the rolling element 18 rolls on the printed circuit 8 reducing substantially to zero the friction with the paths 10, 11 and 12 and thus practically eliminating completely the wear of the components involved and guaranteeing a longer service life of the switch 1.

It is understood that the invention is not limited to the embodiment described and illustrated herein, which is to be considered purely as an example of implementation of the switch for roof lights, which may, instead undergo further modifications as regards shapes and arrangements of parts and details of construction and assembly.

What is claimed is:

1. A switch for roof lights, comprising: a supporting frame; a push-button slidably mounted on the frame; a printed circuit, which is associated to the frame and defines two operative positions for a lamp-bulb; and an actuator, which is set between the push-button and the printed circuit and is moved by the push-button between the two operative positions, wherein the actuator comprises a rolling element, which can roll on the printed circuit between the two operative positions, and a motion-imparting arm, which supports the rolling element and is actuated by the push-button to moved the rolling element itself between the operative positions.

2. The switch according to claim 1, wherein the printed circuit comprises: a first path and a second path, which are made of conductive material and are set aligned to one another and separated from one another to define said operative positions; and a continuous path made of conductive material, which is set adjacent to the first and second paths; said rolling element being defined by a rocker, which is made of conductive material and is set forming a bridge between the continuous path and the first path, in one first operative position of said two operative positions, and between the continuous path and the second path, in one second operative position of said two operative positions.

3. The switch according to claim 1, wherein the actuator comprises: a containing body, which is mounted so that it can slide within the frame; and an elastic element compressed between the containing body and the motion-imparting arm.

4. The switch according to claim 3, wherein said motion-imparting arm is pivoted on the containing body and is set inside the containing body itself together with said elastic element.

5. The switch according to claim 4, wherein said motion-imparting arm comprises an oscillating end for supporting said rolling element and blocking means set in a position corresponding to the oscillating end to block said elastic elements.

6. The switch according to claim 1, wherein the actuator comprises: a desmodromic cam set on the outside of said containing body; a finger, which is engaged by the desmodromic cam; and an oscillating arm, which supports at one first end thereof said finger and is pivoted at a second end thereof on said frame.

7. The switch according to claim 6, wherein said push-button is mobile with reciprocating motion along an axis (A) transverse to said printed circuit.

* * * * *